US005884617A

United States Patent [19]

Nelson

[11] Patent Number: 5,884,617

[45] Date of Patent: Mar. 23, 1999

[54] BOWSTRING

[75] Inventor: Rex A. Nelson, Grand Junction, Colo.

[73] Assignee: Western Filament, Inc., Grand Junction, Colo.

[21] Appl. No.: 843,243

[22] Filed: Apr. 14, 1997

Related U.S. Application Data

[60] Provisional application No. 60/015,776, Apr. 16, 1996.

[51] Int. Cl.[6] ..... F41B 5/14

[52] U.S. Cl. ..... 124/90

[58] Field of Search ..... 124/90; 87/5, 8, 87/13

[56] References Cited

U.S. PATENT DOCUMENTS

| | | | |
|---|---|---|---|
| 2,769,439 | 11/1956 | Layer | 124/90 |
| 2,921,572 | 1/1960 | Miller et al. | 124/90 X |
| 3,545,334 | 12/1970 | Dudley | 87/8 |
| 3,561,318 | 2/1971 | Andriot | 87/8 X |
| 4,702,067 | 10/1987 | Izuta | 124/90 X |
| 4,754,685 | 7/1988 | Kite et al. | 87/9 |
| 4,957,094 | 9/1990 | Pickering et al. | 124/24.1 |
| 5,322,049 | 6/1994 | Dunlap | 124/90 |
| 5,598,831 | 2/1997 | Izuta | 124/90 |

OTHER PUBLICATIONS

Sabit Adanur; Wellington Sears Handbook of Industrial Textiles; pp. 133–135.

Bernard P. Corbman; Textiles:Fiber to Fabric, Decorative Fabric Construction; 1 page.

*Primary Examiner*—John A. Ricci

*Attorney, Agent, or Firm*—Trask, Britt & Rossa

[57] ABSTRACT

Bowstrings are constructed of braided strands, preferably comprising flat braids, from a high strength mixture of yarns comprising abrasion-resistant fibers and yarns comprising high strength, creep resistant fibers.

21 Claims, 3 Drawing Sheets

BOWSTRING

BACKGROUND OF THE INVENTION

Priority Claim: Pursuant to the provisions of 35 USC § 119(e), this application claims the priority of Provisional Patent Application Ser. No. 60/015,776, filed Apr. 16, 1996 for "BOWSTRING."

1. Field of the Invention

This invention pertains to bowstrings for archery bows. It is particularly directed to bowstrings having multiple strands of braided construction.

2. State of the Art

Modern archery bowstrings comprise a plurality of individual strands gathered together in a central nocking region and at respective common ends. Typically, the individual strands comprise bundles of twisted fibers. These bowstrings are conventionally provided with "servings" in the areas where abrasion resistance is crucial, such as where an arrow is nocked, or on the end loops which connect to the limbs of a bow. A serving typically comprises a line of relatively small diameter wound around the bowstring transverse its individual strands. Servings prevent abrasion damage to the string, and provide an attachment surface for nock sets or other indicators intended to guide proper placement of an arrow nock with respect to the string.

Typical problems encountered by archers using conventional bowstrings include stretch or creep. U.S. Pat. No. 4,957,094 describes some of the adjustment problems associated with string stretch in compound bows. Migration of servings is another frequent complaint. Servings sometimes cut into the individual strands of a conventional bowstring, thereby creating regions of stress concentration, a condition which often leads to premature breakage.

Braiding is a well established method of fabric formation. A braid structure is formed by the diagonal intersection of yarns, generally without the warp and/or filling yarns conventionally present in woven fabrics. A twisted fiber bundle may function as a yarn in braiding technology. Two-dimensional circular or flat braids are formed by crossing individual yarns alternately over and under one or more intersecting yarns in a repeating pattern. Common braid designs include "diamond," "regular," and "hercules," which are structured with 1/1, 2/2 and 3/3 intersection repeats, respectively, all as explained by the publication Wellington Sears Handbook of Industrial Textiles, Sabit Adanur, Technomic Publishing Co., Inc., Lancaster, Pa. (1995).

Triaxial braiding introduces axial yarns to the braid structure. These yarns do not generally interlace with the diagonal yarns, being trapped in place between those interlacing sets. Triaxial braids are especially useful for composite yarns. "Circular" (also called "tubular" or "round") braids may be either hollow or "solid" the later being formed around an axial center core. Circular braids are formed from an even number of yarns. A solid braid of this type is composed of a "sleeve" and a core. The core may be of any selected shape and material composition. By contrast, flat braids are formed as a flat strip or tape. "Plain" flat braids are constructed from an uneven number of yarns, while diamond flat braids are formed from an even number of yarns. Other braided structures may be formed through three-dimensional braiding techniques.

SUMMARY

This invention provides a braided strand bowstring. That is, at least a portion of the strands included within a bowstring are of braided construction. Bowstrings of this invention offer longer life, with reduced creep over prolonged use. The braided strands may be of various cross sectional configurations, rectilinear braids being presently preferred. While bowstrings including strands of virtually any braided construction are advantageous, as compared to conventional bowstrings, flat braid strands provide superior holding characteristics for bowstring servings.

A notable characteristic of braided strands generally is their inherently relatively rough exterior surface. This rough surface texture offers significant resistance to serving migration. Round braids are thus suitable for the fabrication of improved bowstrings in accordance with this invention. The geometry of flat braids offers additional advantages, however. A plurality of flat braid strands may be gathered into a bundle having an approximately round cross sectional configuration transverse a longitudinal axis. This configuration is generally preferred in the served region(s) of the string. The initial flat shape of the strands provides additional external irregularity to the served portion of the string to further resist migration of the servings up or down. Additional resistance to serving migration is provided by the expanded rectilinear braid configuration at opposite ends of the served region.

A bowstring of this invention is ideally braided from yarns comprising continuous filament fiber bundles. An exemplary embodiment divides those bundles approximately evenly into two populations containing fibers of distinctly different properties. Of course, certain braid structures require an uneven number of yarns, so that an exact division is often impractical. Moreover, it is within contemplation that a bundle may contain more than one type of fiber, and/or that a particular braided strand of a bowstring may contain more than two types of fibers. This disclosure focuses on embodiments of relatively simple design, but the general principles thereby illustrated can be readily applied to more complex embodiments.

In the specific case of a bowstring fashioned from two populations of fiber bundle yarns, the first such population ordinarily contains fibers (or filaments) offering excellent abrasion resistance. The second such population ordinarily contains fibers offering excellent resistance to creep.

Preferred embodiments of this invention provide a bowstring made up of a plurality of braided bowstring strands. Each strand is characterized by a rectangular cross section. Ideally, the cross section has a width dimension several times as large as its thickness dimension. Moreover, each such strand typically comprises a high strength mixture of yarns comprising abrasion-resistant fibers, (notably of high-density polyolefin, such as polyethylene), and yarns comprising high strength, creep-resistant fibers, (notably of liquid crystal polyester.) The two types of fibers may be present in various proportions, but suitable bowstring strands may be fashioned from an approximately equal number of yams of each material.

A preferred high strength abrasion-resistant yarn material may be selected from those currently being sold under the trademarks Spectra® or Dynema®, and a presently preferred high strength creep-resistant yarn material is that currently being sold under the trademark Vectran®. A notable characteristic of Vectran® material is its roughness. It is generally unsuitable for use as a bowstring material because of its tendency to self-abrade. Alternating yarns of this material with yarns of an abrasion resistant material in a braided structure provides a means for utilizing its excellent creep-resistant properties.

The disclosure of U.S. Pat. No. 4,754,685 is incorporated by reference as a part of this disclosure for its description of the materials and manner of construction of an abrasion-resistant braided sleeve. The disclosure of U.S. Pat. No. 4,957,094 is incorporated by reference for its description of non-stretch bowstring materials, particularly at col. 6, line 27–col. 7, line 43.

DETAILED DESCRIPTION OF THE ILLUSTRATED EMBODIMENTS

Figure 1:
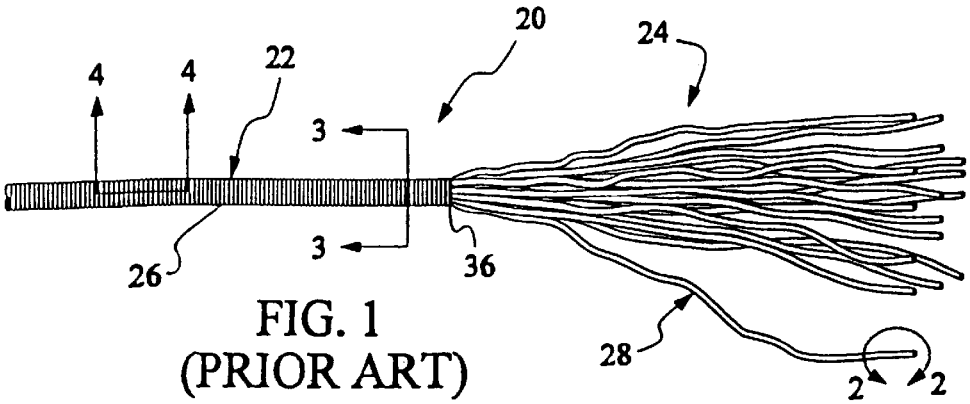
FIG. 1 (PRIOR ART)
FIG. 1 is a fragmentary pictorial view of a portion of a bowstring of the prior art fashioned from twisted fiber bundles.
Figure 2:
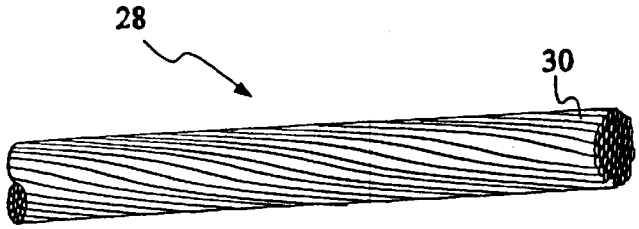
FIG. 2 (PRIOR ART)
FIG. 2 is an enlarged view of a portion of the bowstring of FIG. 1, taken from within the boundary 2—2 of FIG. 1.
Figure 3:
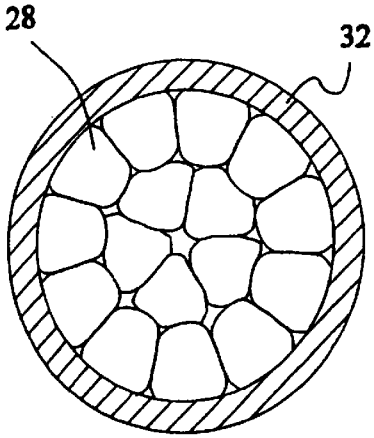
FIG. 3 (PRIOR ART)
FIG. 3 is an enlarged view in cross section, taken at the reference line 3—3 of FIG. 1, as viewed in the direction of the arrows.
Figure 4:
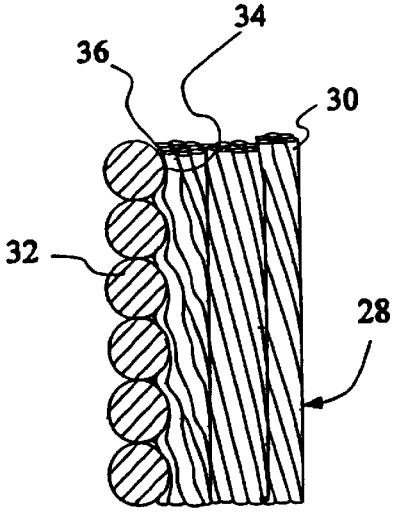
FIG. 4 (PRIOR ART)
FIG. 4 is an enlarged fragmentary view in elevation taken at the reference line 4—4 of FIG. 1, as viewed in the direction of the arrows.

FIGS. 1–4 illustrate a central segment, generally 20, of a conventional bowstring. The segment 20 illustrated includes a portion, generally 22, of a served nocking section and a portion, generally 24, of the stretch between the serving 26 and an attachment end (not shown). The attachment end is structurally adapted to make a connection with a bow limb. The string 20 is constructed of a multiplicity of strands 28, each comprising a twisted bundle of individual filaments or fibers (30, FIG. 4). The strands 28 are bunched together into an approximately circular cylindrical nocking region 22, being held in place by the serving 26. The serving 26 comprises a line 32 of relatively small diameter, wound tightly around the nocking region 22. As best shown by FIGS. 3 and 4, serving line 30 characteristically abrades or otherwise cuts into the individual strands 28 as the string is drawn repetitively to launch arrows. The abraded regions 34, particularly at the terminus 36 of the serving 26, tend to fail in service. In addition, the serving 26 tends to loosen with use, and to migrate, either up or down over time, thereby changing the position of any nock indicator (not shown) carried by the serving. The materials conventionally selected for use as filaments 30 in the bundles 28 are considered to be excellent for bowstring applications, but nevertheless are subject to stretch and creep.

Figure 5:
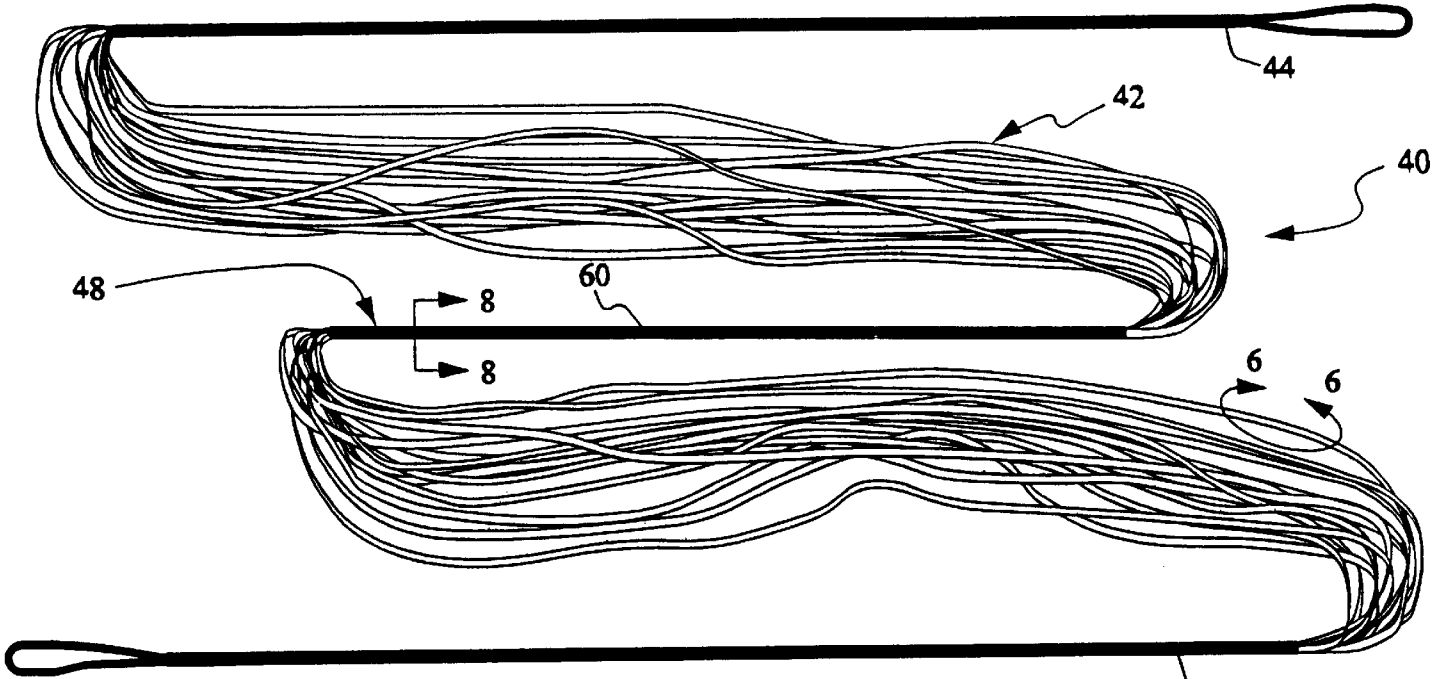
FIG. 5 is a pictorial view of a bowstring of this invention.
Figure 8:
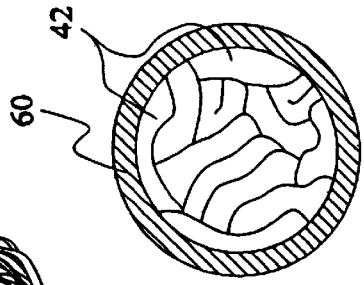
FIG. 8 is an enlarged view in cross section, taken at the reference line 8—8 of FIG. 5, as viewed in the direction of the arrows.
Figure 7:
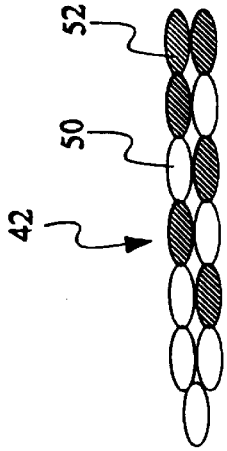
FIG. 7 is a view in cross section, further enlarged, taken at the reference line 7—7 of FIG. 6, as viewed in the direction of the arrows.
Figure 6:
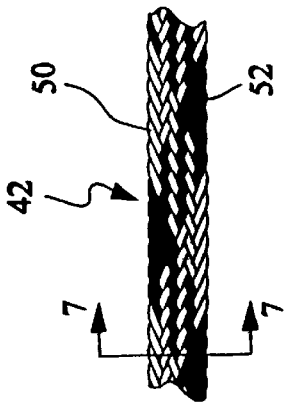
FIG. 6 is an enlarged view of a portion of the bowstring of FIG. 5, taken from within the boundary 6—6 of FIG. 5, illustrating a preferred flat braided filament structure.
Figure 9:
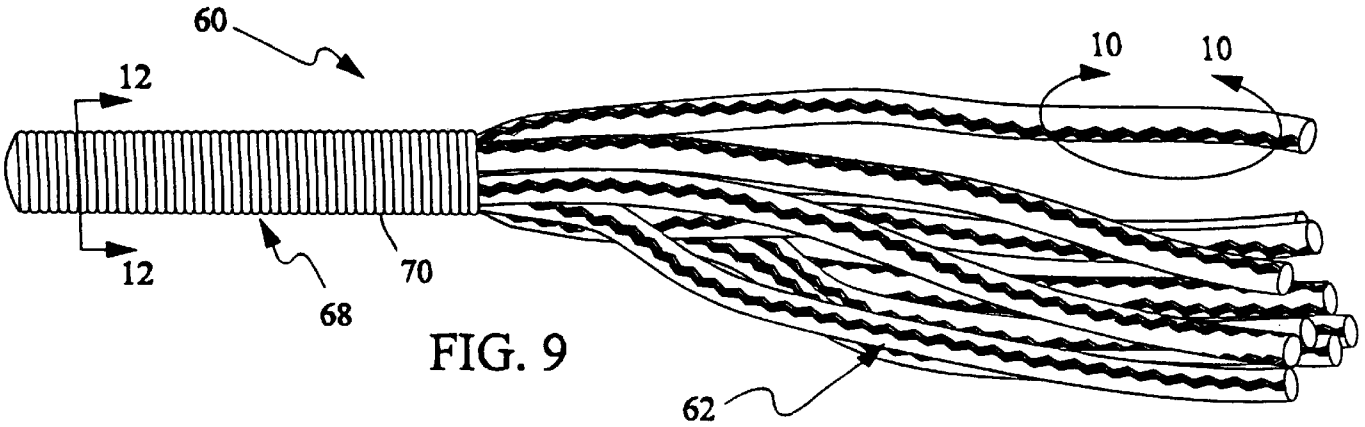
FIG. 9 is a pictorial view of an alternative bowstring of this invention.

FIG. 5 illustrates a complete bowstring, generally 40, of conventional construction except that it utilizes a plurality of strands, generally 42, of flat braid construction. It includes served anchoring loops 44, 46 at opposite attachment ends and a served central nocking section, generally 48. FIGS. 6, 7 and 8 illustrate significant differences between the braided strands 42 of the bowstring 40 and prior art bowstrings of the type illustrated by FIGS. 1–4.

As illustrated, the braids 42 may be formed on a conventional flat braider in a more or less conventional manner. A first population of yarns 50 comprise bundles of filaments of a high strength abrasion-resistant material, such as Spectra®. A second population of yarns 52 comprise bundles of filaments of high strength, creep-resistant material. One specific example of such a bowstring 40 comprises approximately 46% Vectran® fibers and 54% Spectra® fibers. The Vectran® material has a creep ratio of 0.5%, while the Spectra® material has a creep ratio of 2.11%. The bicomponent flat braid 42 thus utilizes the abrasion resistance of Spectra® fibers in combination with the low rate of creep of Vectran® fibers. The resulting strand 42 is of a rectangular cross section with a fairly high aspect ratio, as shown by FIGS. 6 and 7. This cross section is advantageous adjacent the serving 60 of the nocking section 48 in that it tends to hold the serving 60 in position. It should be noted that the flat braids 42 may be gathered, as shown by FIG. 8, to conform to the conventional round cross section preferred for the served nocking region 48.

The serving 60 is illustrated as being of conventional construction and materials of construction, similar to that shown by FIGS. 3 and 4. The tendency of the strands 42 to abrade at the serving is reduced, both by the nature of the interface between the serving 60 and the strands 42, and by the abrasion resistance properties of the Spectra® fiber bundles 50. The surface irregularity of the braided configuration of the strands 42, the natural roughness of the Vectran® bundles 52 and rectilinear cross sectional configuration of the strands 42 (FIG. 7) all contribute to a notable advantage of bowstrings constructed in accordance with this invention; resistance to migration of the serving 60 during prolonged use of the string 40. This advantage is present to a substantial degree even when the braided strands are of circular, as opposed to flat construction.

Figure 12:
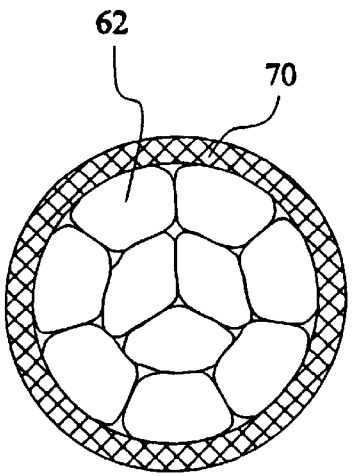
FIG. 12 is an enlarged view in cross section, taken at the reference line 12—12 of FIG. 9, as viewed in the direction of the arrows.
Figure 11:
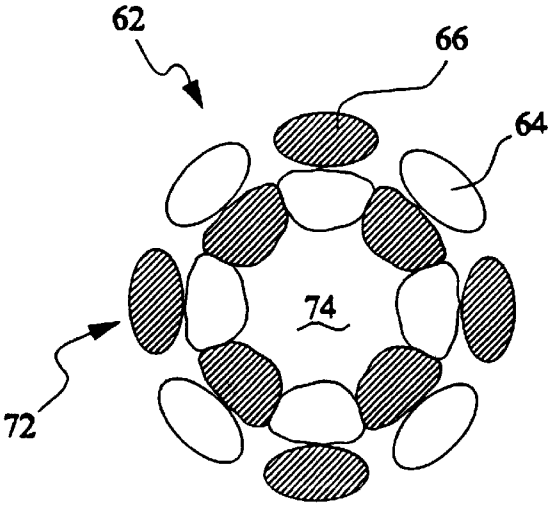
FIG. 11 is a view in cross section, further enlarged, taken at the reference line 11—11 of FIG. 9, as viewed in the direction of the arrows.
Figure 10:
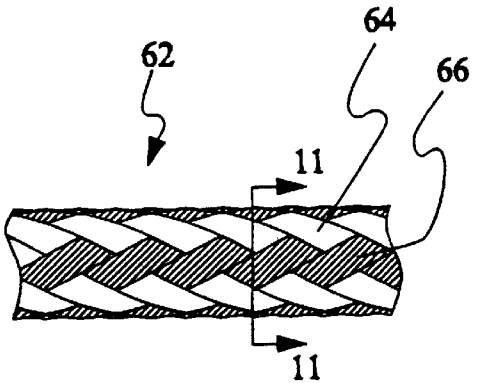
FIG. 10 is an enlarged view of a portion of the bowstring of FIG. 9, taken from within the boundary 10—10 of FIG. 9, illustrating a round braided filament structure.

FIGS. 9–12 illustrate a segment, generally 60, of an alternative bowstring constructed as explained in connection with FIGS. 5–8, but utilizing strands, generally 62, constructed as round braids. These braids 62 are constructed of equal numbers of bundles 64 of abrasion resistant fibers and bundles 66 of creep resistant fibers. The nocking section 68 is served with a transversely wound serving line 70 in conventional fashion, as shown by FIG. 12. As best shown by FIG. 11, the round braids 62 are formed as a sleeve, generally 72, enclosing a hollow core 74. It is within contemplation for this core 74 to be occupied by an axial yarn of selected properties.

Reference in this disclosure to details of the illustrated or preferred embodiments is not intended to limit the scope of the appended claims, which themselves recite those details regarded as important to the invention.

What is claimed is:

1. A bowstring comprising a plurality of strands, each such strand comprising:

a first plurality of bundles of abrasion-resistant fibers; and a second plurality of bundles of creep-resistant fibers;

said first and second pluralities of bundles being fashioned into a braid.

2. A bowstring according to claim 1, wherein said first and second pluralities are of approximately equal number.

3. A bowstring according to claim 1, wherein the fibers of all said bundles are manufactured from polymeric resinous materials.

4. A bowstring according to claim 1, wherein each said braid has a longitudinal axis and an approximately rectilinear cross sectional configuration transverse said axis.

5. A bowstring according to claim 4, wherein said braids are gathered at a central nocking region such that their respective longitudinal axes are approximately parallel a longitudinal axis of said bowstring, and a serving line is wrapped about said braids transverse said longitudinal axis of said bowstring.

6. In a bowstring having a longitudinal axis, a first end structured as a first loop, a second end structured as a second loop and a central nocking region, the improvement comprising fashioning said bowstring from a plurality of braided strands.

7. An improvement according to claim 6, wherein said strands are constructed as flat braids, each characterized by an approximately rectangular cross section transverse said longitudinal axis.

8. An improvement according to claim 7, wherein said cross section has a width several times greater than its thickness.

9. An improvement according to claim 6, wherein said braided strands are fashioned from a first population of bundles of abrasion-resistant fibers and a second population of bundles of creep-resistant fibers.

10. An improvement according to claim 9, wherein said braided strands each have a rectangular cross section transverse said longitudinal axis.

11. An improvement according to claim 10, wherein said cross section has a width several times greater than its thickness.

12. An improvement according to claim 9, wherein said abrasion-resistant fibers comprise high-density polyolefin and said creep-resistant fibers comprise liquid crystal polyester.

13. An improvement according to claim 12 wherein said braids are flat braids.

14. In a bowstring structured from a plurality of strands extending between opposite attachment ends, the improvement comprising providing at least a portion of said strands in the form of braids constructed of a high strength mixture of yarns comprising abrasion-resistant fibers and yarns comprising high strength, creep-resistant fibers.

15. An improvement according to claim 14, wherein said abrasion-resistant fibers comprise high-density polyolefin and said creep-resistant fibers comprise liquid crystal polyester.

16. An improvement according to claim 14 wherein said braids are flat braids.

17. An improvement according to claim 15 wherein said mixture includes approximately equal numbers of yarns of high density polyolefin and liquid crystal polyester.

18. An improvement according to claim 16, wherein said abrasion-resistant fibers comprise high-density polyolefin and said creep-resistant fibers comprise liquid crystal polyester.

19. A bowstring, structured with anchoring loops at opposite attachment ends and a central nocking section between said attachment ends, said bowstring comprising:

a first plurality of strands of abrasion-resistant fibers; and a second plurality of strands of creep-resistant fibers;

said first and second pluralities of strands being fashioned into a braid.

20. A bowstring according to claim 19, wherein said first and second pluralities are of approximately equal number.

21. A bowstring according to claim 19, wherein the fibers of all said bundles are manufactured from polymeric resinous materials.

* * * * *